US005410832A

United States Patent [19]

Barnhart

[11] Patent Number: 5,410,832

[45] Date of Patent: May 2, 1995

[54] WEAPON CHAMBER SAFETY PLUG KIT

[76] Inventor: Terry L. Barnhart, 2828 Wildwood Cir., Odessa, Tex. 79761

[21] Appl. No.: 199,005

[22] Filed: Feb. 18, 1994

[51] Int. Cl.[6] ..... F41A 17/44

[52] U.S. Cl. ..... 42/70.11; 42/1.05

[58] Field of Search ..... 42/70.11, 70.01, 1.05, 42/66

[56] References Cited

U.S. PATENT DOCUMENTS

| | | | |
|---|---|---|---|
| 3,604,136 | 9/1971 | Edwards | 42/70.01 |
| 3,710,490 | 1/1973 | Cornett et al. | 42/70.11 |
| 4,084,340 | 4/1978 | Scudder | 42/70.11 |
| 4,224,753 | 9/1980 | Bielman | 42/70.11 |
| 4,776,123 | 10/1988 | Ascroft | 42/96 |
| 4,835,894 | 6/1989 | Libassi | 42/70.11 |
| 4,965,952 | 10/1990 | Miller et al. | 42/70.01 |
| 5,014,457 | 5/1991 | Lewis et al. | 42/70.11 |
| 5,062,233 | 11/1991 | Brown | 42/70.11 |
| 5,070,635 | 12/1991 | Cvetanovich | 42/70.11 |

FOREIGN PATENT DOCUMENTS

| | | | |
|---|---|---|---|
| 2561369 | 9/1985 | France | 42/70.11 |

*Primary Examiner*—Stephen M. Johnson

[57] ABSTRACT

A plug member configured in a complementary relationship relative to a weapon firearm chamber is provided. The plug includes a rear wall having a flexible flag strip extending therefrom to project from the firearm when the firearm is arranged to cover the firearm chamber, thereby indicating a positioning of the plug within for visual indication of a safety firearm capable of transport and handling.

5 Claims, 3 Drawing Sheets

FIG. 1
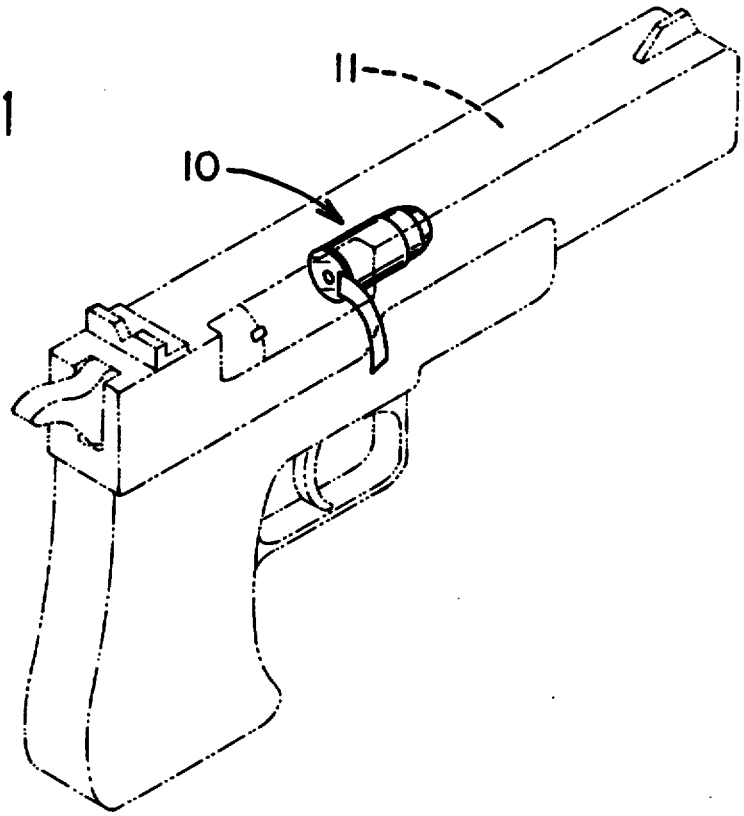
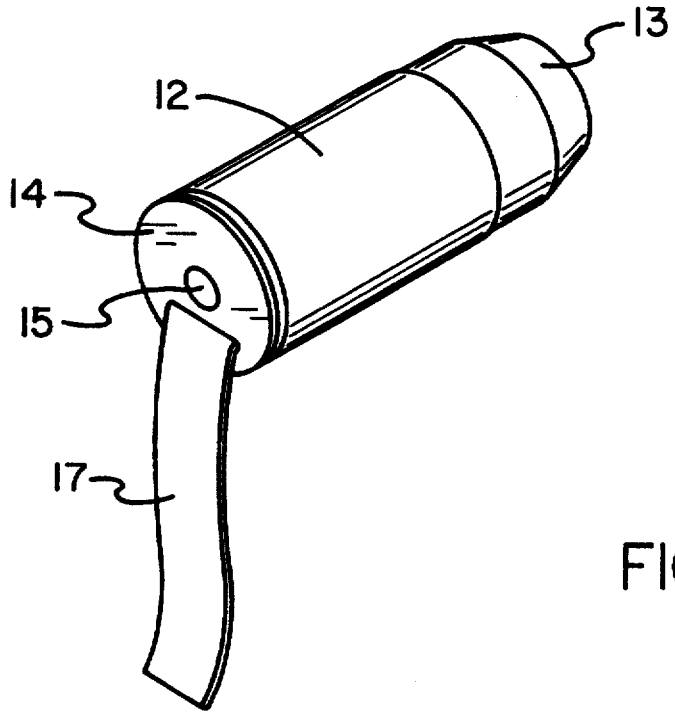
FIG. 2

FIG. 3
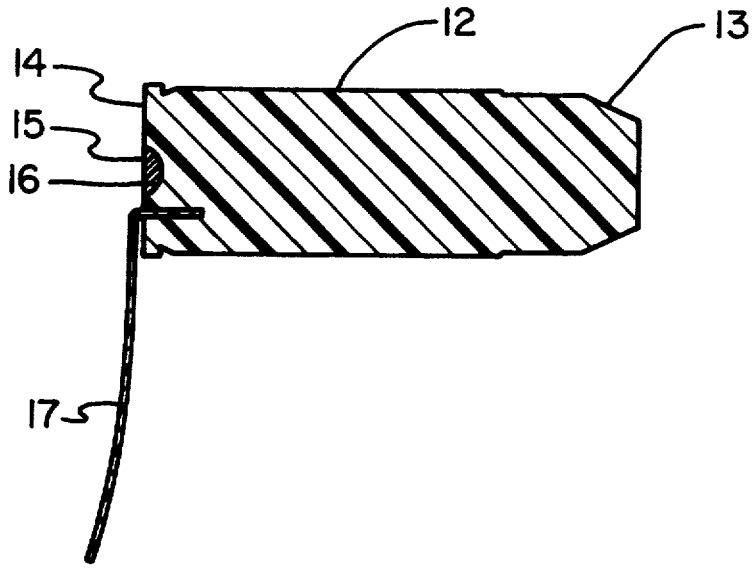
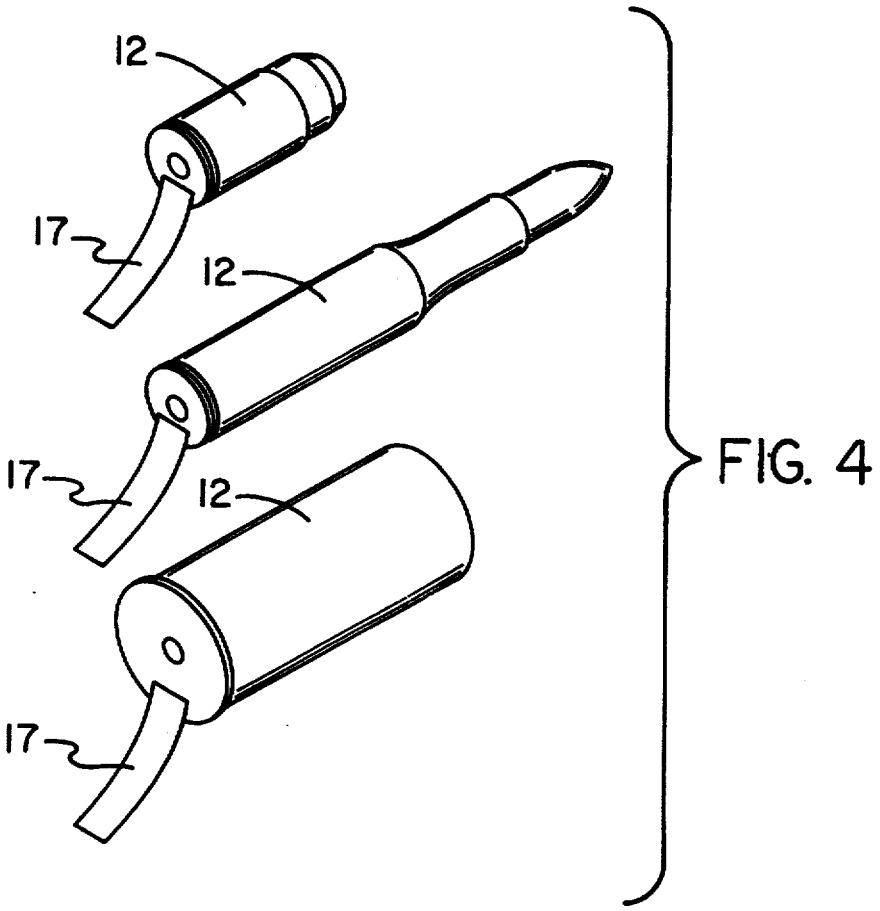
FIG. 4

FIG. 5
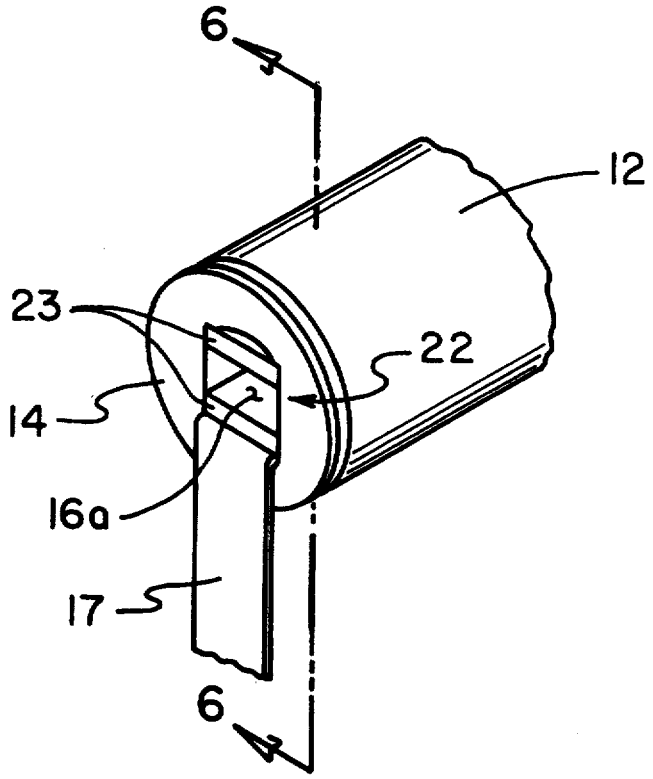
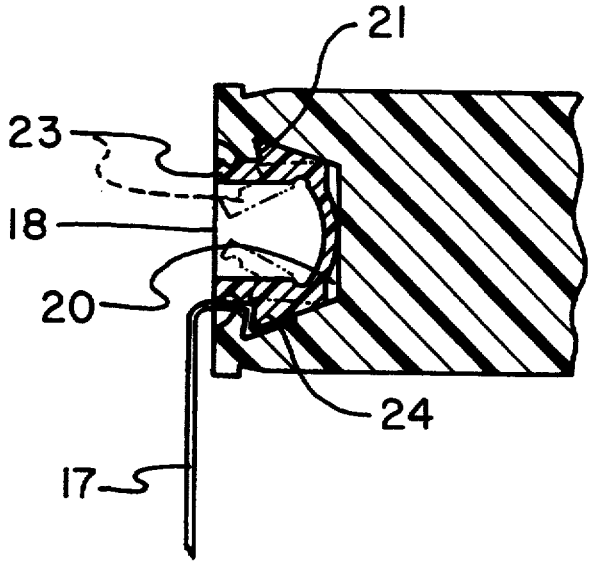
FIG. 6

WEAPON CHAMBER SAFETY PLUG KIT

BACKGROUND OF THE INVENTION

1. Field of the Invention

The field of invention relates to safety plug structure, and more particularly, to a new weapon chamber safety plug kit wherein the same is arranged to be complementarily received within a firearm chamber, and to further include an indicator flag for visual indication of weapon safety.

2. Description of the Prior Art

Safety plugs for firearm chambers are available in the prior art and indicated in U.S. Pat. Nos. 4,965,952; 5,070,635; 4,776,123; and 5,014,457.

The instant invention attempts to overcome deficiencies of the prior art to permit the further inclusion of a flag to project beyond the firearm housing for indication of positioning of the plug within the firearm for alerting other individuals as to the safety of the firearm identifying the firearm as unloaded and available for handling and in this respect, the present invention substantially fulfills this need.

SUMMARY OF THE INVENTION

In view of the disadvantages inherent in the known types of firearm safety plug structure now present in the prior art, the present invention provides a weapon chamber safety plug kit wherein the same is arranged to include a plug member projecting within a firearm chamber having a flexible flag projecting beyond the firearm housing when the firearm is enclosed about the chamber. As such, the general purpose of the present invention, which will be described subsequently in greater detail, is to provide a new weapon chamber safety plug kit apparatus and method which has many of the advantages of the prior art listed heretofore and many novel features that result in a weapon chamber safety plug kit apparatus which is not anticipated, rendered obvious, suggested, or even implied by any of the prior art, either alone or in any combination thereof.

To attain this, the present invention provides a plug member configured in a complementary relationship relative to a weapon firearm chamber is provided. The plug includes a rear wall having a flexible flag strip extending therefrom to project from the firearm when the firearm is arranged to cover the firearm chamber, thereby indicating a positioning of the plug within for visual indication of a safety firearm capable of transport and handling.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new weapon chamber safety plug kit apparatus and method which has many of the advantages of the prior art listed heretofore and many novel features that result in a weapon chamber safety plug kit apparatus which is not anticipated, rendered obvious, suggested, or even implied by any of the prior art, either alone or in any combination thereof.

It is another object of the present invention to provide a new weapon chamber safety plug kit which may be easily and efficiently manufactured and marketed.

A further object of the present invention to provide a new weapon chamber safety plug kit which is of a durable and reliable construction.

An even further object of the present invention is to provide a new weapon chamber safety plug kit which is susceptible of a low cost of manufacture with regard to both materials and labor, and which accordingly is then susceptible of sale to the consuming public, thereby making such weapon chamber safety plug kits economically available to the buying public.

Still yet another object of the present invention is to provide a new weapon chamber safety plug kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention

FIG. 2 is an enlarged isometric illustration of the plug structure.

FIG. 3 is an orthographic cross-sectional illustration of the safety plug structure.

FIG. 4 is an isometric illustration of the safety plug arranged in various configurations to accommodate various firearm chambers.

FIG. 5 is an isometric illustration of a rear wall structure of the safety plug.

FIG. 6 is an cross sectional view, taken along the lines 6—6 of FIG. 5 in the direction indicated by the arrows.

DESCRIPTION OF THE PREFERRED EMBODIMENT

With reference now to the drawings, and in particular to FIGS. 1–6 thereof, a new weapon chamber safety plug kit embodying the principles and concepts of the present invention and generally designated by the reference numeral 10 will be described.

More specifically, the weapon chamber safety plug kit 10 of the instant invention is arranged for reception within a firearm 11 having a firing chamber to receive the structure 10. With this in mind, it can be shown that the invention comprises plug member including a cylindrical body portion 12 having a head portion 13, such as a bullet representation, which may be received complementarily within the chamber of the gun 11. It should be noted that the plug structure 12 may be configured to accommodate various chambers, such as indicated in FIG. 4, to include, for example, a pistol bullet, a rifle bullet, or a shotgun shell, as shown in descending vertical pictorial configuration.

To this end, each of the plugs includes a cylindrical body portion 12, having a body portion rear wall 14 (see FIG. 2), including a fire pin cushion 15 positioned within a rear wall recess 16. The fire pin cushion 15 operable to absorb the impact of the firing pin of the firearm should the weapon be fired with the plug kit 10 in the chamber, thereby precluding damage to such firing pin. A flexible flag strip 17 extends from the rear wall 14 to project beyond the firearm housing, such as indicated in FIG. 1, to provide for visual observation of positioning of the plug to thereby indicate to individuals of the safety of the firearm in handling, such as a firing range and the like. It is important that the flag strip 17 be of a flexible nature such that the firearm chamber may be closed while still allowing for the projection of the flag exterior of the firearm through the tortuous passage typically found in most firearms.

The FIG. 5 indicates a rear wall recess 16a arranged with a recess floor 0 and a recess entrance 18 directed into the recess, wherein spaced flanges 21 in a facing relationship relative to the floor 20 are oriented radially beyond the floor and positioned on diametrically opposed sides thereof between the floor the recess entrance 18. In this manner, an insert 22 having insert flexible legs 23 may be received within the recess **16*a*, with each of the flexible legs 23 including a leg flange 24 received within a respective spaced flange 20 of the plurality of the spaced flanges 21 to capture the flexible flag strip 17 between the insert 22, and more specifically, between one of the insert legs 23**. In this manner, various colorations of flag strips may be employed to indicate relative condition of the firearm, when the firearm is to be reused, and the like. In this manner, coding of the firearm and its condition and intended use may be provided.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A weapon chamber safety plug kit comprising:

a plug member having a cylindrical body portion, with the body portion arranged for reception within a firearm chamber, the body portion having a rear wall and being symmetrically oriented about a longitudinal axis, the rear wall being orthogonally oriented relative to the axis, with the rear wall having a rear wall recess located medially of the rear wall for receiving a fire pin therewithin; and, a substantially flat, flexible flag strip extending from the rear wall and substantially orthogonally relative to said longitudinal axis for passing through a tortuous passage of a firearm and projecting both laterally and exteriorly of said firearm when said firearm chamber is closed.

2. A kit as set forth in claim 1, wherein the recess includes a recess floor, a recess side wall, and a recess entrance coplanar with the rear wall, with the recess side wall including spaced flanges in a facing relationship relative to the floor and extending radially beyond the floor, the spaced flanges being positioned between the recess entrance and the floor, and further comprising an insert having insert flexible legs, with each said flexible leg having a leg flange, with each said leg flanges arranged for reception within one of said spaced flanges, and the flag strip extending into the recess and captured between one of said legs and one of said spaced flanges, thereby permitting replacement of said flag strip.

3. A kit as set forth in claim 2, wherein the plug member is shaped as a pistol bullet.

4. A kit as set forth in claim 2, wherein the plug member is shaped as a rifle bullet.

5. A kit as set forth in claim 2, wherein the plug member is shaped as a shotgun shell.

* * * * *